US005165786A

United States Patent [19]

Hubert

[11] Patent Number: 5,165,786

[45] Date of Patent: Nov. 24, 1992

[54] MEDICAL PROJECTOR, MORE PARTICULARLY FOR A SURGICAL USE

[75] Inventor: Jean Hubert, Paris, France

[73] Assignee: Alm, Societe de Droit Francais, Le Pre-Saint-Gervais, France

[21] Appl. No.: 608,774

[22] Filed: Nov. 5, 1990

[30] Foreign Application Priority Data

Feb. 6, 1990 [FR] France ..... 90 01322

[51] Int. Cl.[5] ..... F21V 21/00

[52] U.S. Cl. ..... 362/287; 362/272; 362/394; 362/399; 362/804

[58] Field of Search ..... 362/269, 272, 271, 285, 362/287, 368, 370, 384, 385, 394, 399, 428, 804

[56] References Cited

U.S. PATENT DOCUMENTS

| | | | |
|---|---|---|---|
| 2,911,519 | 11/1959 | Phillips et al. | 362/272 |
| 3,005,087 | 10/1961 | Klein | 362/275 |
| 3,075,071 | 1/1963 | Lauterbach | 362/285 |
| 4,316,238 | 2/1982 | Booty et al. | 362/385 |
| 4,517,632 | 5/1985 | Roos | 362/394 |
| 4,538,214 | 8/1985 | Fisher et al. | 362/285 |
| 4,801,815 | 1/1989 | Biette et al. | 362/287 |

FOREIGN PATENT DOCUMENTS

| | | |
|---|---|---|
| 1241989 | 8/1960 | France . |
| 1341061 | 8/1963 | France . |
| 2363970 | 3/1978 | France . |
| 2536832 | 6/1984 | France . |

*Primary Examiner*—Stephen F. Husar
*Attorney, Agent, or Firm*—Young & Thompson

[57] ABSTRACT

The projector for medical use comprises an illuminating cupola articulately mounted about different axes and provided along its wider outline with a protecting flange of flexible material dimensioned so as to constitute a device for gripping and operating the cupola and defining an inner chamber bounded, on the outer face of the flange by a sufficiently thin wall to be deformed by manual pressure and allowing the operation of control mechanisms of a device for unblocking and reblocking articulation brakes of arm supports of the capola.

7 Claims, 3 Drawing Sheets

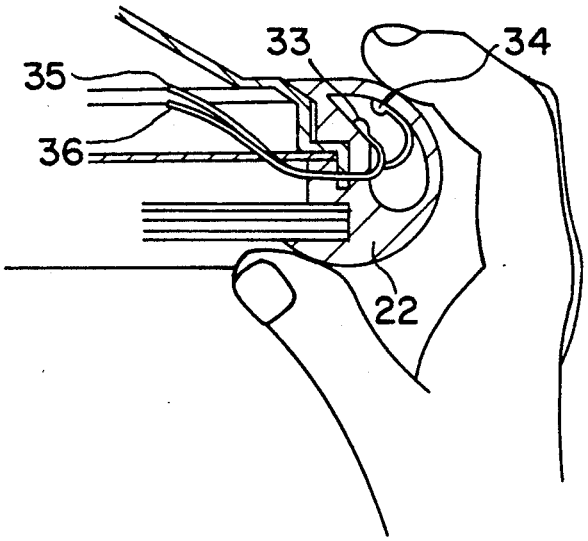
FIG. 4
FIG. 5
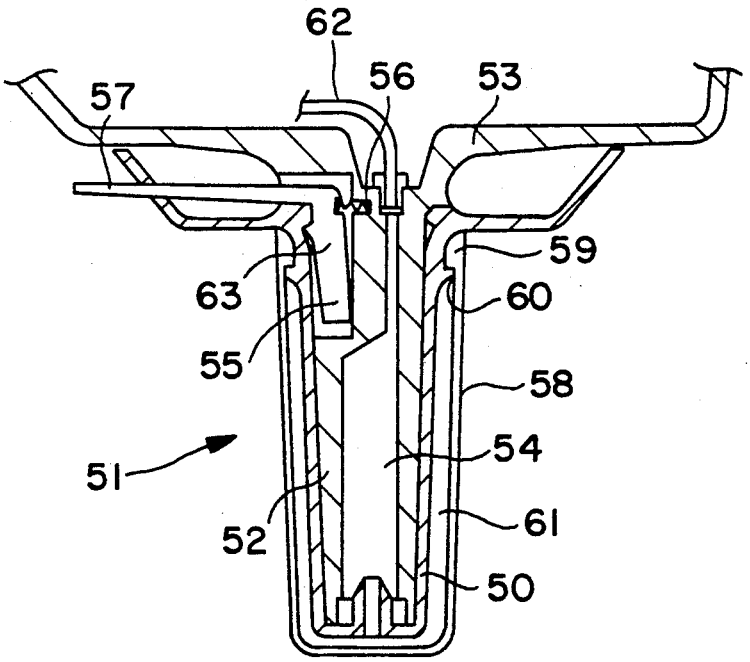

MEDICAL PROJECTOR, MORE PARTICULARLY FOR A SURGICAL USE

BACKGROUND OF THE INVENTION a) Field of the Invention

The present invention concerns a medical projector, more particularly for surgical use of the type comprising an illuminating cupola articulately mounted about different positioning and orientation axes, and provided, on at least a portion of its wider peripheral outline, with a protecting flange of flexible material.

b) Description of the Prior Art

A projector of this type has been described in FR-A-1.241.989. This kind of illuminating material which hangs over an operating table is adapted to be operated by the surgeon or his assistants, and in a manner to permanently obtain a sufficient illumination of the operating site during the entire operation. Because the object of the illuminating cupola of the projector is to illuminate an operating site notwithstanding the working position of the surgeon, its diametrical dimension is substantial and, since it is associated with different support arms which are articulated with one another, it constitutes a system which is necessarily cumbersome. The illuminating cupola is adapted to be moved by the operator at a height of the order of two meters above ground level, with the result that, at any moment, it can be directly moved by the operator.

In the above document, handling of the cupola is carried out by means of a handle located at the center of the optical portion thereof.

SUMMARY OF THE INVENTION

It is an object of the invention to facilitate the operation and the adjustment of the position of the illuminating cupola.

For this purpose, according to a characteristic of the invention, the protecting flange of flexible material is dimensioned so as to constitute a gripping device for operating the cupola. Advantageously, to facilitate its assembly and to limit the inertia of the cupola, the protecting flange has an inner cavity defining a recess.

Projectors, for example, those of large dimensions, are presently provided with means for blocking into position, articulations of orientations of the type provided with spring loaded brakes and blocking/unblocking devices, as described in the patent document FR-A-2.536.832. In this document, the blocking means are controlled by a control circuit with capacitive effect comprising captors disposed in the central handle or in a handling hoop.

It is another object of the present invention to facilitate the handling and the adjustment into position of the cupola, while achieving low cost, compactness, reliability and a high flexibility in use.

For this purpose, according to another characteristic of the invention, the recess is bound on the outer phase of the flange by a wall which is sufficiently thin to be deformed by manual pressure and comprises control means, which are susceptible to be deformed by local depression of said thin wall portion to control the articulation blocking means.

With such an arrangement, the flange provides the operations of protection against shocks, handling and control of the blocking means, by permitting the working of electrical or pneumatical control means which are not sensitive to environmental conditions of an operating site notwithstanding the relative positioning of the cupola and of the operator.

BRIEF DESCRIPTION OF THE DRAWINGS

Other characteristics and advantages of the invention will appear from the description which follows of embodiments given by way of examples, with reference to the annexed drawings in which:

FIGS. 3 and 4 are views similar to FIG. 2 showing two variants;

FIG. 5 is a cross-section view of a centrally mounted operating handle of a projector.

DESCRIPTION OF PREFERRED EMBODIMENTS

Figure 1:
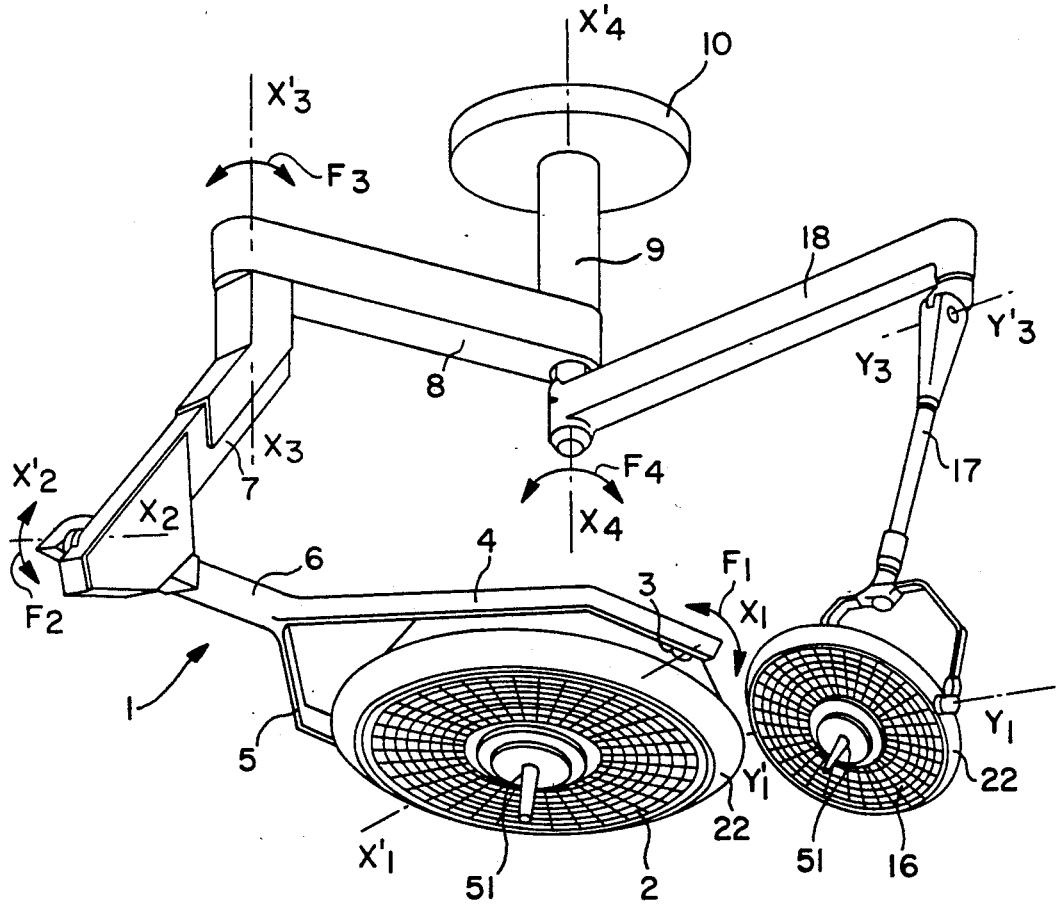
FIG. 1 is a perspective view of illuminating projectors, according to the invention.
Figure 2:
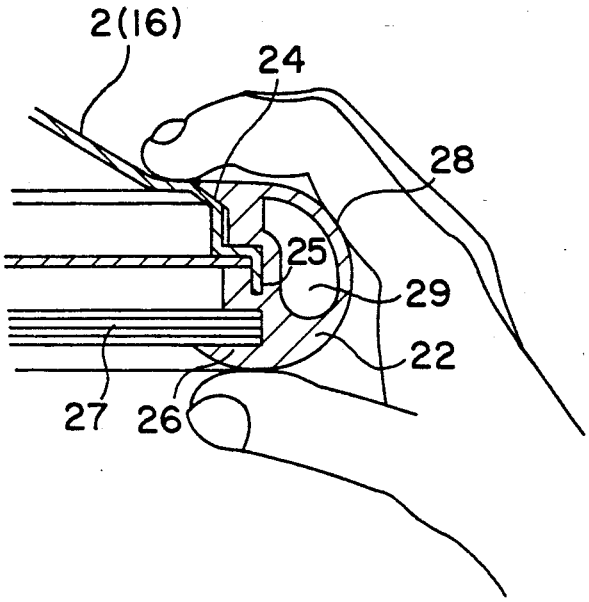
FIG. 2 is a cross-section view of a detail of the projector of FIG. 1.

With reference to FIGS. 1 and 2, a surgical illuminating device 1 generally comprises a main illuminating cupola 2 rotatably mounted for swinging movement in the direction of the double arrow $F_1$ about a horizontal axis $X_1X'_1$, by means of a pair of diametrically opposed pivot pins—of which one appears at 3—mounted at the ends of two arms 4 and 5 which are unitary with a fork 6. Fork 6 is articulately mounted for swinging movement in the direction of the double arrow $F_2$ about an axis $X_2X'_2$ on a substantially vertically extending arm 7, which itself is rotatably mounted for swinging movement in the direction of the double arrow $F_3$ about axis $X_3X'_3$ on a horizontally extending support arm 8 which is rotatably articulated for swinging movement in the direction of the double arrow $F_4$ about vertical axis $X_4X'_4$ on a tubular support 9 fixedly mounted at the ceiling of an operating room by means of a circular coupling 10.

Thus, cupola 2 may be oriented by rotation about axis $X_1X'_1$, brought nearer or moved away by rotation about axis $X_2X'_2$, and positioned in space, by rotation about axes $X_3X'_3$ and $X_4X'_4$.

In practice, there is provided at least one additional projector with cupola 16 of more restricted dimensions, said cupola 16 being mounted about an axis $Y_1Y'_1$ of a fork shaped support articulately mounted to rotate about an axis $Y_2Y'_2$ on an arm 17 which itself is articulately mounted according to axis $Y_3Y'_3$ on an arm 10 which is articulated for swinging movement int he direction of the double arrow $F_4$ about axis $X_4X'_4$ of the tubular support 9.

As better illustrated in FIG. 2, each illuminating cupola 2, 16, having a wide lower edge, is provided on its periphery with a flange 22 of flexible material which protects each cupola against shocks. Each cupola has an inner outline defining an annular shoulder 24, an annular central snapping groove 25 to receive the outer edge of cupola 2,16 and a wide annular groove 26 holding an optical plate 27. The outer periphery 28 of the protective flange 22 was a convexly rounded shape so as to permit the absorption of any shock between the cupola 2(16) and a surrounding object and between cupolas 2 and 16. This protective flange 22 is recessed to form an inner recess 29 to increase its flexibility and facilitate its assembly.

Figure 3:
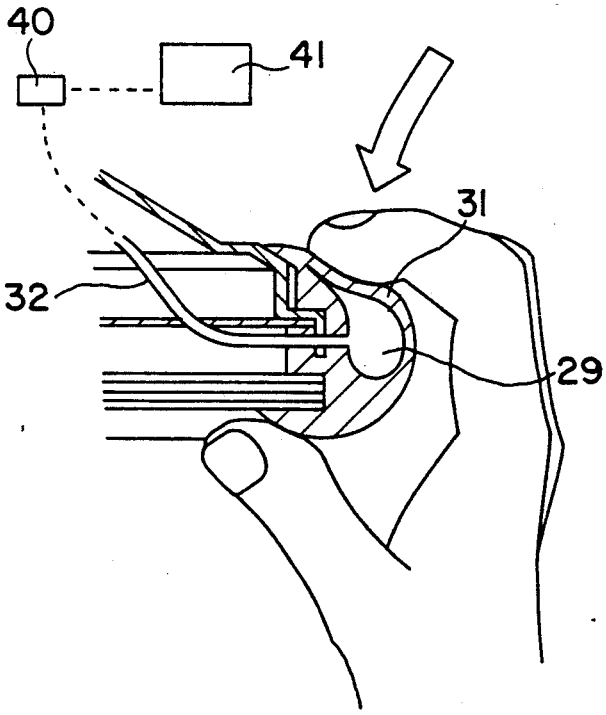

Flange 22 is transversely dimensioned so as to constitute a gripping device which can be operated by an operator as represented in FIGS. 2, 3 and 4. In this manner, by simple direct gripping of this flange 22, it is possible to ensure all desired re-orientation about axis $X_1X'_1$ ($Y_1Y'_1$), $X_2X'_2$ ($Y_2Y'_2$), $X_3X'_3$ ($Y_3Y'_3$) and even $X_4X'_4$, without requiring operating hoops unitary with the cupola.

According to the invention, recess 29 constitutes an annular recess and the flexibility of the material constituting the flange 22 and the thickness of its wall 23 defining its outer boundary are adapted to permit a depression of the flange 22 by simple pressure between the thumb and the index of the hand of the operator. In the embodiment of FIG. 3, the effect of a light overpressure thus obtained is transferred by a fine tube 32 towards a pressure detector 40, which is associated with an articulation blocking means 41 to ensure the unblocking or the reblocking of usual brakes provided on the various articulations (XX') (YY'). These brakes, of known type, are made of a friction surface which is unitary with an arm and is adapted to resiliently rest against a cooperating surface which is unitary with another arm and the resilient action can be counterbalanced by the electromagnetic effect of a magnet which is energized by a current supplied under the control of a signal here produced by pressure detector 40.

Thus, the system of transfer of the signal of the pressure detector can provide a permanent energization of the electromagnets used for unblocking the articulation brakes during the entire phase of overpressure, whose disappearance results in the deenergization of the electromagnets and the reblocking of the brakes, or the unblocking may take place on the occasion of a first signal corresponding to a first overpressure of said unblocking and this can take place until the production of a second overpressure pressure effecting reblocking of the brakes.

Instead of utilizing the overpressure effect described above, it is possible, as a variant, as illustrated in FIG. 4, to use a control means with electrical contacts, for example in the form of two annular contacts 33 and 34 fixedly mounted with mutual small distance apart on the inner walls of the recess 29 to be contacted together under the effect of a slight manual deformation of flange 22. Each annular contact 33(34) is connected by means of a conductor 35 (36) and a transfer device, to the blocking means 41 to supply to the latter a control signal for the unblocking-reblocking of the articulation brakes.

With reference to FIG. 5, a central operating handle 51 intended for a fine adjustment of the illuminating cupola 2 (16) is made in the form of a rigid sleeve 50 which is mounted on an outwardly axially projecting nipple 52 of the cupola central support 53 and defines an axial inner recess 54. The rigid sleeve 51 is fixedly mounted in position by means of a snap 63 articulated at 55 and activatable by a locking spring 56. The rigid handle 51 has an arm 57 which produces the escape of snap 63 when it is lowered. Around this sleeve 51 there is an engaged flexible sheet 58 which is locked by engagement of an end shoulder 59 past an edge 60 of the rigid sleeve 51. There is thus also produced an annular recess 61 which communicates via 54 with a tube 62 for connection with the pressure detector 40. Gripping of the handle by the surgeon thus produces an overpressure which is transferred to the detector and, as described previously, ensures the unblocking of the articulation brakes of the cupola support arms. It is to be noted that the handle is easily removable in order to be sterilized.

The present invention is applicable to the illumination of operating tables, to systems of distribution in operating rooms and rooms for intensive care and to apparatus used in radiology.

I claim:

1. A medical light comprising a lighting cupola supported on a hinged support structure having at least one lockable hinge device, the cupola having an end portion of wider peripheral outline provided with a peripheral protective ring of a resilient material and formed with an inner chamber having an outer wall portion, the protective ring being shaped so as to form a gripping device for an operator to maneuver the cupola.

2. The medial light of claim 1, wherein the hinge device comprises remotely controlled braking and locking means actuatable in response to the manual deformation of said wall portion of the protective ring by the operator.

3. The medical light of claim 2, wherein said braking and locking means are responsive to a pneumatic signal resulting from depression of the wall portion.

4. The medical light of claim 2, wherein said braking and locking means are responsive to an electric signal resulting from depression of the wall portion.

5. The medical light of claim 4, wherein the wall portion is operatively coupled to electrical switch means.

6. The medical light of claim 5, wherein the wall portion carries a contact member to the switch means.

7. The medical light of claim 1, wherein the protective ring is hollow.

* * * * *